US005300836A

United States Patent [19]

Cha

[11] Patent Number: 5,300,836

[45] Date of Patent: Apr. 5, 1994

[54] FLAME ROD STRUCTURE, AND A COMPENSATING CIRCUIT AND CONTROL METHOD THEREOF

[75] Inventor: Soo Y. Cha, Seoul, Rep. of Korea

[73] Assignee: Samsung Electronics Co., Ltd., Suwon, Rep. of Korea

[21] Appl. No.: 905,363

[22] Filed: Jun. 29, 1992

[30] Foreign Application Priority Data

Jun. 28, 1991 [KR] Rep. of Korea ..... 91-10926

[51] Int. Cl.[5] ..... H03K 5/22; G06G 7/10

[52] U.S. Cl. ..... 307/491; 307/310; 307/354; 307/358; 43/66

[58] Field of Search ..... 307/491, 310, 354, 358; 431/66

[56] References Cited

U.S. PATENT DOCUMENTS 4,087,232 5/1978 Budlane ..... 431/66

4,161,387 7/1979 Courier de Méré431 ..... 66/

*Primary Examiner*—Margaret R. Wambach

*Attorney, Agent, or Firm*—Burns, Doane, Swecker & Mathis

[57] ABSTRACT

A flame rod structure is comprised of a silicon alloy or is coated by a silicon material on a metal flame rod. A compensating circuit applies the A.C. bias to the D.C. bias of the flame rod structure, generates the excitation frequency signal and mixes the excitation frequency with the D.C. bias to produce a reference frequency according to the flame sensing of the flame rod structure, whereby a calorific step is accurately detected to control the optimum heating of a burner or a combustion apparatus.

15 Claims, 7 Drawing Sheets

FLAME ROD STRUCTURE, AND A COMPENSATING CIRCUIT AND CONTROL METHOD THEREOF

BACKGROUND OF THE INVENTION

The invention relates to a flame rod structure provided with a cladding of a semiconductor material, and a compensating circuit for promoting reliable operation of the flame rod structure and a control method thereof.

PRIOR ART

Generally, a custom heater or heater and a combustion apparatus have used fossil fuels to control a number of calories generated during heating based on flame sensing, in which flame sensing requires a metal material which can endure relatively high heat. In other words, the flame rod structure is made in the form of a metal rod as a sensor for detecting the generated amount of calories, oxygen concentration, firing and non-firing relative to the flame state of fossil fuels like petroleum. The flame rod detects a flame current of a predetermined voltage generated upon the combustion of fossil fuels, so that its equivalent circuit can be designed in a modelling pattern.

The flame current on the flame rod is first converted into a small amount of ion current according to the combination of carbon and oxygen during the combustion of fossil fuels. Therefore, as shown in FIG. 1 the flame rod may be considered an ideal diode because its ion current flows in one direction or is forward-biased. Then, the difference Ri of the flame resistance dependent upon the number of calories generated during heating is generated. The drift of charge components (relative to the time elapsed) forces the flame rod to have a small amount of electrostatic capacity Ci according to the heating state. Also, the flame rod has a resistance value RL due to the leakage current generated by its structural factors and the combustion condition.

The characteristic of the voltage to the current of the flame rod is illustrated in FIG. 2. The forward characteristic of direct current (D.C.) represents the vector value of the leakage current value RL to the flame resistance value per hour. The flame resistance Ri is proportional to the total calories Ro (related with the temperature and the time), and the leakage current resistance RL is proportional to the value of R (the structural factor of the flame rod) multiplying the square of flame resistance Ri.

The electrical alternate current (A.C.) characteristic of the flame rod is shown in FIG. 3. That is, the relationship of the electrical A.C. to the flame current fluctuates with a heating change according to the amount of calories absorbed, which is determined by the combustion combination rate according to the combustion ratio condition. The capacitance load C is inversely proportional by an exponential function to the heating step. It represents the equation of $Ci \alpha Co(w)$, wherein w is the combustion ratio condition factor.

The flame rod is made of metal material which serves as a conductor (medium) of the heat generated by the combustion flame, but has a conductivity characteristic which degrades according to the time elapsed and the temperature rise. It furthermore has problem with reliability the exterior disturbance (the petroleum quality and the efficiency reduction of the complete combustion under a predetermined combustion ratio condition) and the electrical problems of its associated circuitry leading to the degradation of conductivity, thereby causing function as a conductivity medium as shown in FIG. 4.

The metal flame rod also increases its flame resistance Ri more and more according to the temperature rise as shown in FIG. 5, because its conductivity characteristic accelerates the elastic collision of free electrons.

Additionally, the ion current converted from the flame current flows along the skin surface of the flame rod. The amount of charge is reduced according to the time elapsed, and the smaller the calorie is, the more the electrical AC characteristic of the skin current relative to the heating step is deteriorates as illustrated in FIG. 6.

As a result, the metal flame rod is under the relatively large exterior influences including the calories absorbed, the time and the temperature, so that its electrical characteristic is abruptly changed. It is appreciated that the metal flame rod is not ideal as a conductivity medium or device with respect to the associated circuitry.

The, the electric charge quantity $Q_F$ is represented as follows:

$$Q_F > \alpha Q_C;\ \alpha \leqq 1,$$

wherein $Q_F$: a quantity of the electric charge generated by the flame current $Q_C$: a quantity of the Electric Charge supplied to the electrical network by the flame rod $\alpha$: the flame rod conductivity $\sigma$ (dependent on the temperature characteristic and the supplied electric charge quantity $Q_F$)

On the other hand, the metal flame rod is resistance abruptly increases in the non-conductor area based on the time characteristic curve thereby causing the electrical loss shown in FIG. 4. The flame resistance Ri relative to the time elapsed of the metal flame rod is dependent upon the fuel quality, but the increase of the flame resistance should be introduced only within the scope of the conductivity area. At that time, assuming that the skin current component has a maximum electric charge, the combustion of carbon material occurs adjacent to the skin surface of the flame rod to form a carbon cladding thereon, and the carbon cladding acts as a resistor to increase the flame resistance Ri, infinitely. Accordingly, it is noted that the flame rod may be remarkably improved by using materials which are not subject to the exterior influences like the calorie, the time and the temperature, etc.

Considering these points, if the flame rod structure is able to facilitate the generation of the flame current, be heat resistant property and reduce the skin current, it can be supposed an ideal flame sensor. In other words, the material which causes the reduction of the skin current and the improvement of the conductivity and temperature characteristics related to the flame resistance Ri for overcoming the deficiencies disclosed in FIGS. 4 and 5 is a semiconductor semiconductors are known as a conductivity medium having the excellent characteristics of conductivity and a heat-resistance property.

Therefore, an ideal flame sensor can exist in practice, if the defects of the metal flame rod are removed, and the merits of the semiconductor material are adapted to the flame rod. In order to realize the ideal flame sensor, the flame rod structure can be made of the combination of a metal and a semiconductor.

The semiconductor material is heated to raise its temperature, so that the interior electrons become excited from a bound energy level to become free electrons. As a result, the flame component is charged due to the negative change of negative ions, so that the electrons of the metal flame rod are combined with the positive holes of the semiconductor material to serve as charge components and promote a current drift corresponding to the heating temperature. This effect causes the charge components of the semiconductor material to compensate for the skin current reduction of negative ions generated in aging by raising the temperature.

Therefore, the charge flux is shown as follows:

$$Ju=n(E_C-\mu+3/2\ K_BT)\ (-\mu e)E$$

Wherein,

Ju: charge flux

N: the number of the semiconductor atoms $E_C$: energy level (conductivity band)

$K_B$: Boltzman constant

T: absolute temperature $-\mu e$: mobility of electron

E: applied drift electric field strength

As shown in FIG. 7, the conductivity of the negative ion represents a state when the gradient in the non-conducting region of the high temperature is slightly smaller than that in the usage region.

As FIG. 8 illustrates a flame rod including a cross-sectional portion A and a lateral portion B. The flame rod is wrapped at a predetermined thickness by a semiconductor material. The electric field strength E at the center of the cross-sectional portion A is zero, and the cross-sectional electric field strength E is inversely proportional to a length 1 and proportional to the difference value obtained by subtracting the final voltage $V_2$ from the initial voltage $V_1$.

$$\vec{E}=(V_1-V_2)/l$$

At this point, the metal electrons can be combined with the positive holes of the semiconductor material. The semiconductor material not only increases the interior mobility of the semiconductor material relative to the negative ions by forming the drift electric field, but also conducts the drift current due to the effect (Ju=3/2 KT) obtained by the charge flux thereof according to the temperature rise. At that time, the drift current components compensate for the reduction of the skin current occurred in aging by the combustion flame skin resistance. It is believed not to influence the conductivity of the flame rod as a whole. Consequently, the semiconductor material contributes to draw out the conductance current.

On the other hand, a fluid (air) vibration of the flame rod caused by a combustion flame causes charge fluctuation, so that the conductivity of the medium constituting the flame rod is reduced, if a heating step is low as shown in FIG. 3. This flame rod during the combustion is represented as the equivalent circuit illustrated in FIG. 9. Herein, the D.C. direction is the same as that in FIG. 1. However; the flame rod relative to a current Ii, as illustrated by the A.C. electrical characteristic in FIG. 2, has difficulty in processing the electrical signal like a constant voltage regulated power source, because its interior impedance is relatively large and variable.

It is represented by the following equation.

$$Zi\ (\text{calorie})=V_{FR}/Ji$$

$$Zi\ (W)=V_{FR}(W)/Ji(W)$$

Wherein, $V_{FR}$: voltage of the flame rod

Ji: current of the flame rod

W: change of calorie

Consequently, the flame resistance Ri acts as an interior impedance at low frequencies in shown as FIG. 9. Thus, in order to transmit a larger signal the flame rod needs an associated bias/excitation circuit due to the variability of the resistance value. The method for processing the low frequency signal is illustrated in FIG. 10. It is noted from FIG. 10 that the low frequency band (between WE to WB) is added to the reference frequency $h_W$ and then removed.

For example, $$Q'_{FR}=Q_{FR}*h_W$$

Also, the interior impedance mainly occurs due to the skin resistance. Therefore, the impedance value of Zi can be decreased by properly applying the A.C. bias to a D.C. bias circuit without reducing the capacity component Ci generated by the flow of the skin current illustrated in FIG. 1.

For example, $$Zi=1/WCi$$

Therefore, the design condition of the bias circuit is as follows.

As illustrated in FIG. 11, the current loss at the skin surface should be prevented.

For example, $$Z_A=Z_B+Z_C$$

$$Z_A(W)=Z_B(W)+Z_C(W)$$

Wherein, $Z_A$: interior impedance of excitation circuit $Z_B$: combustion flame voltage+impedance Z of flame rod medium conductivity voltage $Z_C$: impedance Z of circuit C Accordingly, it is necessary to apply the maximum A.C. bias to circuit C so as to minimize the impedance value of $Z_A$.

As described above, if it is based on the flame rod structure and the associated circuit, the flame rod, a so called flame sensor, acts as a variable signal source during operation, so that its conductivity loss may be reduced, and processes the associated with electrical signals associated with relative to the fractionized flame states.

Accordingly, it is an object of the present invention to provide a flame rod structure for restraining current from being generated at the skin surface to reduce the loss due to the variability of the structural interior impedance thereof.

It is a further object of the present invention to provide a flame rod structure including the semiconductor material for improving the conductivity and the temperature characteristic influenced by the flame resistance to reduce the skin surface current thereof.

It is another object of the invention to provide a flame rod structure acting as a sensor having the interior characteristic of high impedance which is minimally affected by the time elapsed and the exterior disturbance.

It is still another object of the invention to provide a compensating circuit for improving the function of the flame rod structure by applying the A.C. bias to the D.C. bias which is the generation factor of the skin current due to the interior impedance of the flame rod.

It is still another object of the invention to provide a method of controlling the compensating circuit for applying the A.C. bias to a flame rod structure.

SUMMARY OF THE INVENTION

According to the present invention, there are two types of flame rod structures. One is comprised of a composition of a semiconductor material and a metal component. A semiconductor material may be silicon and germanium, etc. in the form of a micro-powder, and the metal powder may be iron and nickel, etc. for use as a ferromagnetic substance. Accordingly, these powders are simultaneously sintered and ground into the micro-particles, melted with a predetermined adhesive agent, cooled and pressed/molded at a high pressure, thereby providing the flame rod structure.

The other flame rod structure may be constructed to cover the semiconductor material on a metal flame rod. At that time, the junction portion formed between the semiconductor material and the metal can be considered as a high frequency diode including the resistance rectifying junction portion.

Also, according to the present invention, there is provided a circuit for compensating a skin current by applying an A.C. bias to the D.C. bias of a flame rod structure. The circuit comprises a constant voltage regulated circuit applying the D.C. bias to the flame rod structure; means for generating an excitation frequency signal, which is A.C. biased relative to the flame rod structure; means for mixing the signal of the constant voltage regulated circuit with the signal of the excitation frequency generating means and generating a signal of the predetermined frequency band; means for receiving the signal from the flame rod structure to sense the flame; means for trapping only the excitation signal among the signals from the flame sensing means; means for filtering the trapped signal to leave the actual sensing frequency of the flame signal; means for shaping the waveform of the filtered signal to output it to the first analog/digital converting port of a microprocessor; The microprocessor is connected to the flame rod structure for sensing the flame signal at the second A/D port, converting only the reference frequency corresponding to the excitation frequency into the voltage signal and outputting the D/A converting signal of the reference signal at the third analog/digital port of the microprocessor. Also included is for converting the analog signal from the microprocessor into a voltage to frequency signal and applying it to the excitation signal generating means.

Also, the present invention is provided with a microprocessor constituting a compensating circuit including a method of determining whether the frequency to voltage signal inputted at the first and second A/D port is equal to the previously set frequency to voltage data, outputting the inputted voltage to frequency signal if they are equal. If they are not equal the flame rod voltage is compared with the corresponding set minimum voltage at the sensing time point. If the flame rod voltage is equal to the sensed minimum voltage, then outputting the inputted voltage to frequency signal is outputted. If they are not equal, then the contents of the predetermined RAM data are charged and output as the voltage to frequency signal.

BRIEF DESCRIPTION OF THE DRAWINGS

The present invention will be described in detail below with reference to the attached drawings in which.

DETAILED DESCRIPTION OF THE INVENTION

Figure 1:
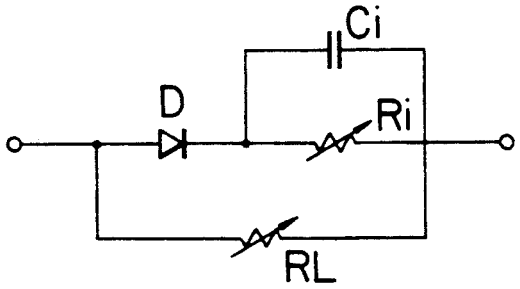
FIG. 1 is an electrical equivalent circuit of a metal flame rod in a burner using fossil fuels.
Figure 2:
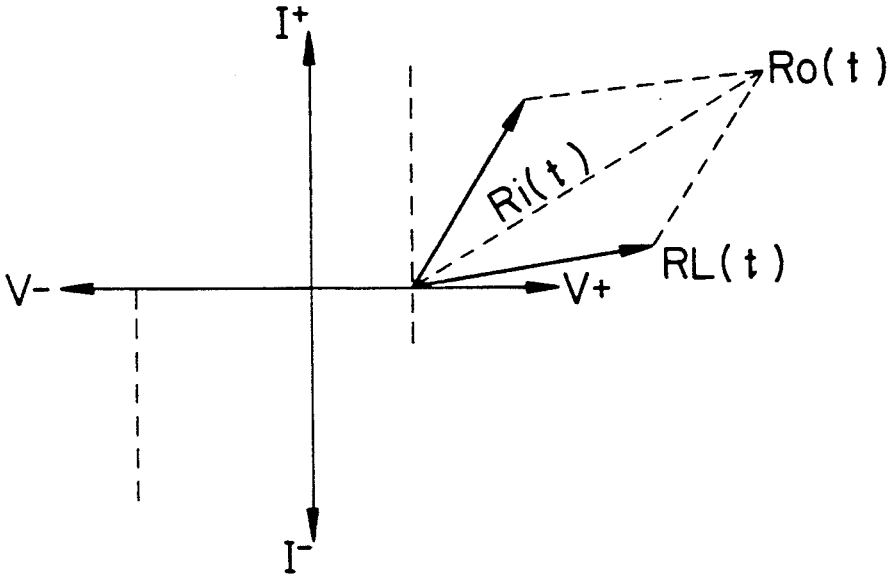
FIG. 2 is a graph illustrating an electrical characteristic related to the D.C. bias of the metal flame rod.
Figure 3:
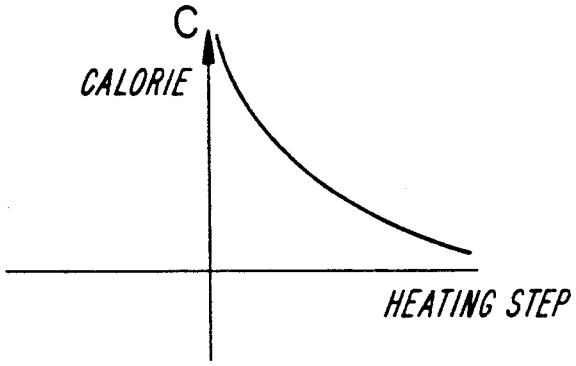
FIG. 3 is a graph illustrating an electrical characteristic related to the A.C. bias of the metal flame rod.
Figure 4:
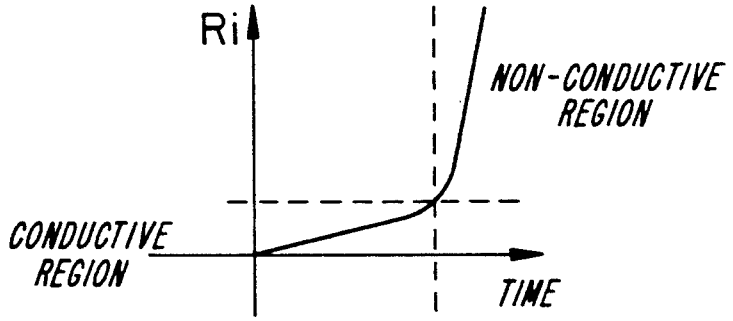
FIG. 4 is a graph illustrating the interior resistance value of the metal flame rod according to the time elapsed.
Figure 5:
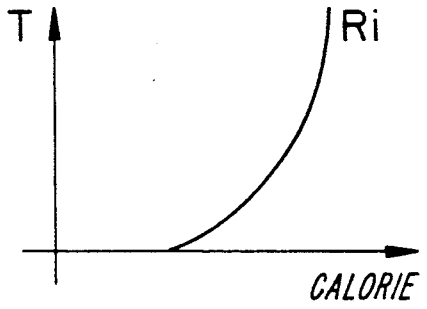
FIG. 5 is a graph illustrating the interior resistance of the metal flame rod related to the temperature rise.
Figure 6:
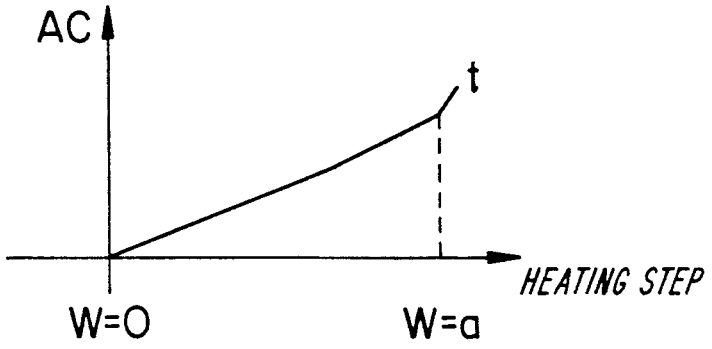
FIG. 6 is a graph illustrating an electrical characteristic according to the heating step associated with the A.C. on-current.
Figure 7:
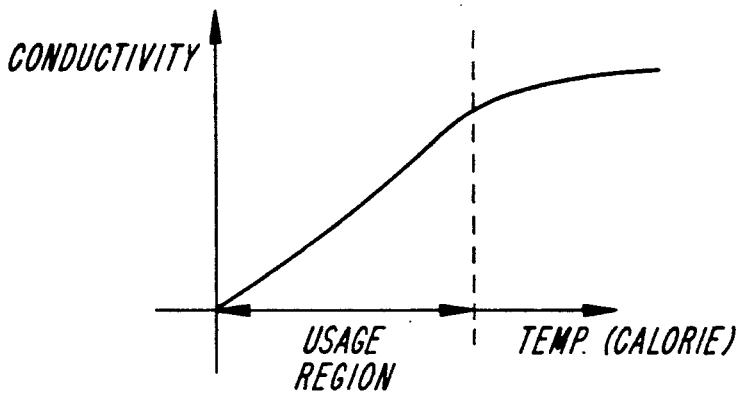
FIG. 7 is a graph associated with the conductivity to the temperature illustrating an electrical characteristic of a flame rod structure which is constructed to have a metal and a semiconductor material according to the present invention.
Figure 8:
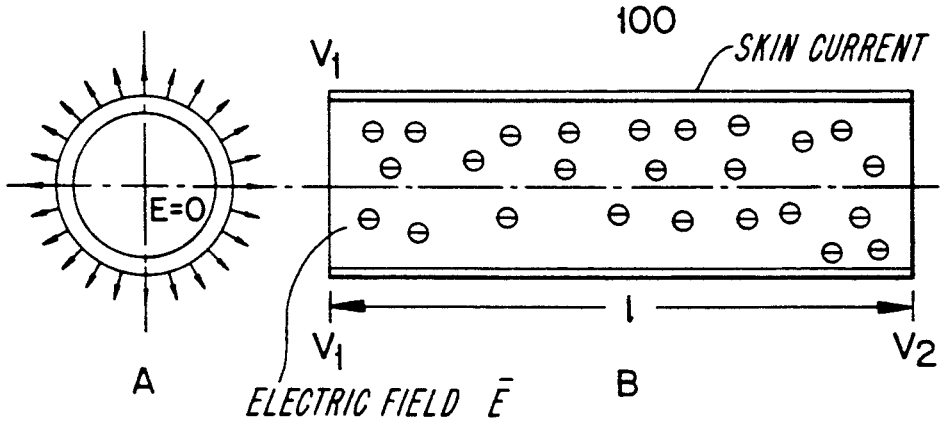
FIG. 8 is a view illustrating the flow of drift current associated with the electric field and direction of the flame rod structure according to the present invention.
Figure 9:
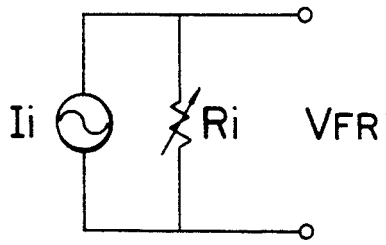
FIG. 9 is an equivalent circuit view illustrating the electrical characteristic of the flame rod structure during sensing of the flame.
Figure 10:
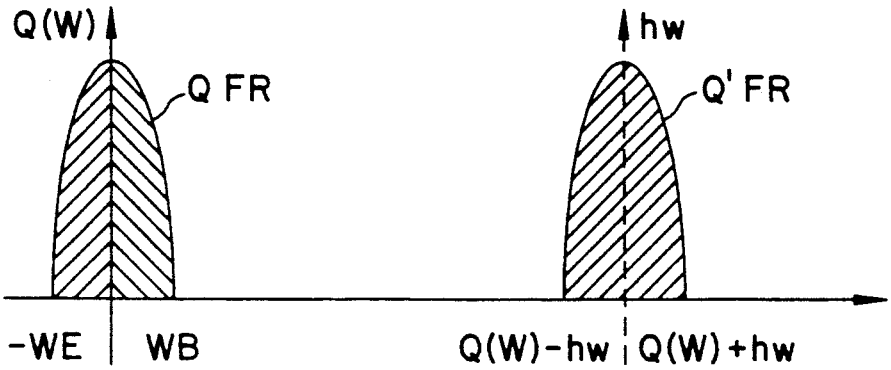
FIG. 10 is a view illustrating one example for removing a low frequency and high impedance while varying the interior impedance of the flame rod structure.
Figure 11:
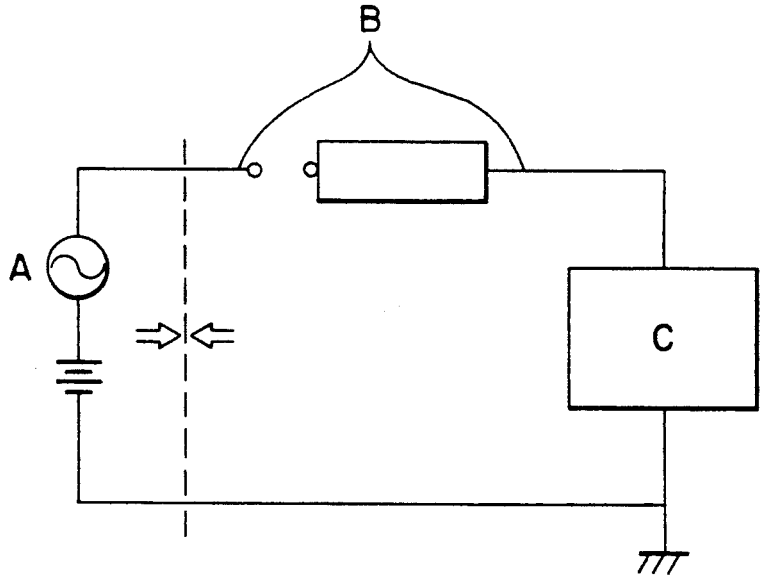
FIG. 11 is a schematic view illustrating the concept of adding the A.C. bias to the D.C. bias, which is performed in the flame rod structure according to the principle of the present invention.

According to the present invention, as shown in FIG. 8, a flame rod structure 100 generates a drift current to increase the interior electron mobility as a conductor, thereby reducing the skin current and increasing the quantity of drift current according to a rise in temperature. The temperature rise increases the charge flux Ju by about 3/2 KT.

The flame rod structure of the present invention is produced through one of two methods. One method is to prepare a semiconductor composition comprised of a micro-particular magnetic substance. For example, an iron-semiconductor alloy is prepared by using the micro-powder of silicon, germanium as a semiconductor and iron, nickel as a metal powder. For example, the typically silicon alloy is formed so that the silicon powder of 3-5% by its weight ratio is sintered with the metal powder, crushed into the micro-particles, melted with the predetermined adhesive agent, such as an elastic adhesive agent, cooled and pressed/molded at a high pressure.

The flame rod structure is electrically adapted to a high frequency application like the clad structure of a laminate type on the metal flame rod as described below, so that it improves the electrical characteristic such as the conductivity in the high temperature condition and especially has a low core loss, a high permeability and a low eddy current loss due to the increasing of the electrical resistance.

The other flame rod structure is prepared by coating the semiconductor material on the metal flame rod. Herein, metal semiconductor junction portion constitutes the low-resistance region of a rectifying junction portion. Therefore, this junction portion can be used as a high-frequency diode. Meanwhile, this semiconductor(dielectric substance) surface provides an electrical conduction path in parallel with the volume portion of the metal flame rod, where the electrical conduction is characterized by the surface resistance value.

The dielectric substance of silicon causes the skin electrical conduction in a humid environment. At that time, if it is used as a flame sensor, the dielectric substance can not generate charge drifting on the skin surface, thereby losing the conductivity function.

Additionally, the current at a high frequency is induced adjacent to the skin surface of the conductor or the flame rod structure, in which the skin depth is defined to reduce the current density by 1/e on the skin surface, and the skin resistance Rs is the D.C. resistance value of the conductor having the thickness of the skin depth.

The surface (skin) resistance is as follows:

$$Rs=\rho/\delta=1/\alpha\delta$$

Wherein, $\rho$=electrical resistance ($\Omega$—m), $\delta$=thickness (m)

$\sigma$=electrical conductivity ($\upsilon$/m)

Figure 12:
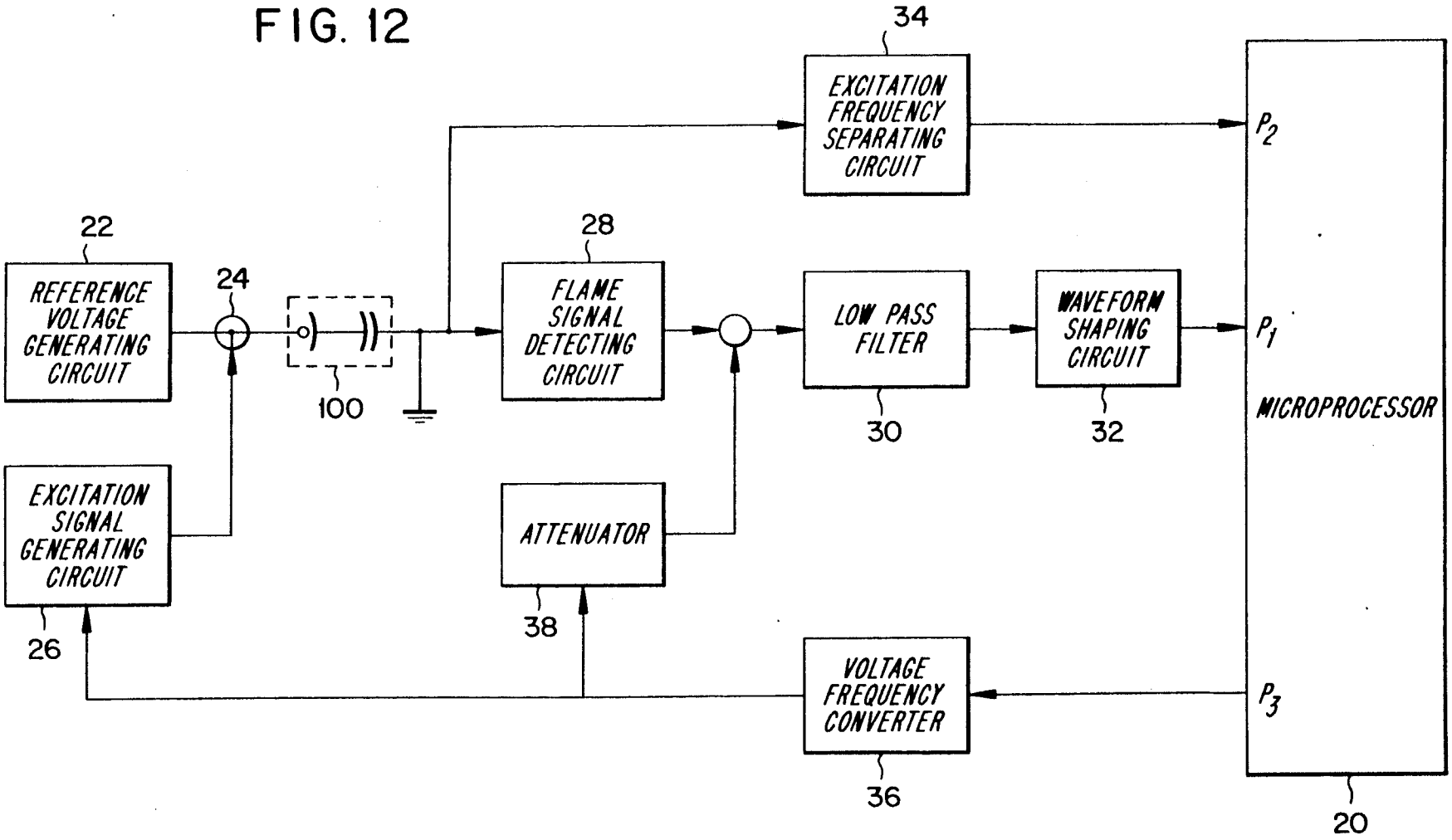
FIG. 12 is a block diagram illustrating a compensating circuit for improving the electric characteristic of the flame rod structure according to the principle of the present invention.

FIG. 12 is a block diagram of a compensating circuit according to the principle of the present invention.

The compensating circuit is provided with a microprocessor 20 so as to generate the excitation frequency relative to the flame rod structure which is a flame sensor. In the other words, the flame rod structure 100 is connected to a mixer 24 at one end thereof, which receives input signals from a reference voltage generating circuit 22 and an excitation signal generating circuit 26.

Figure 14:
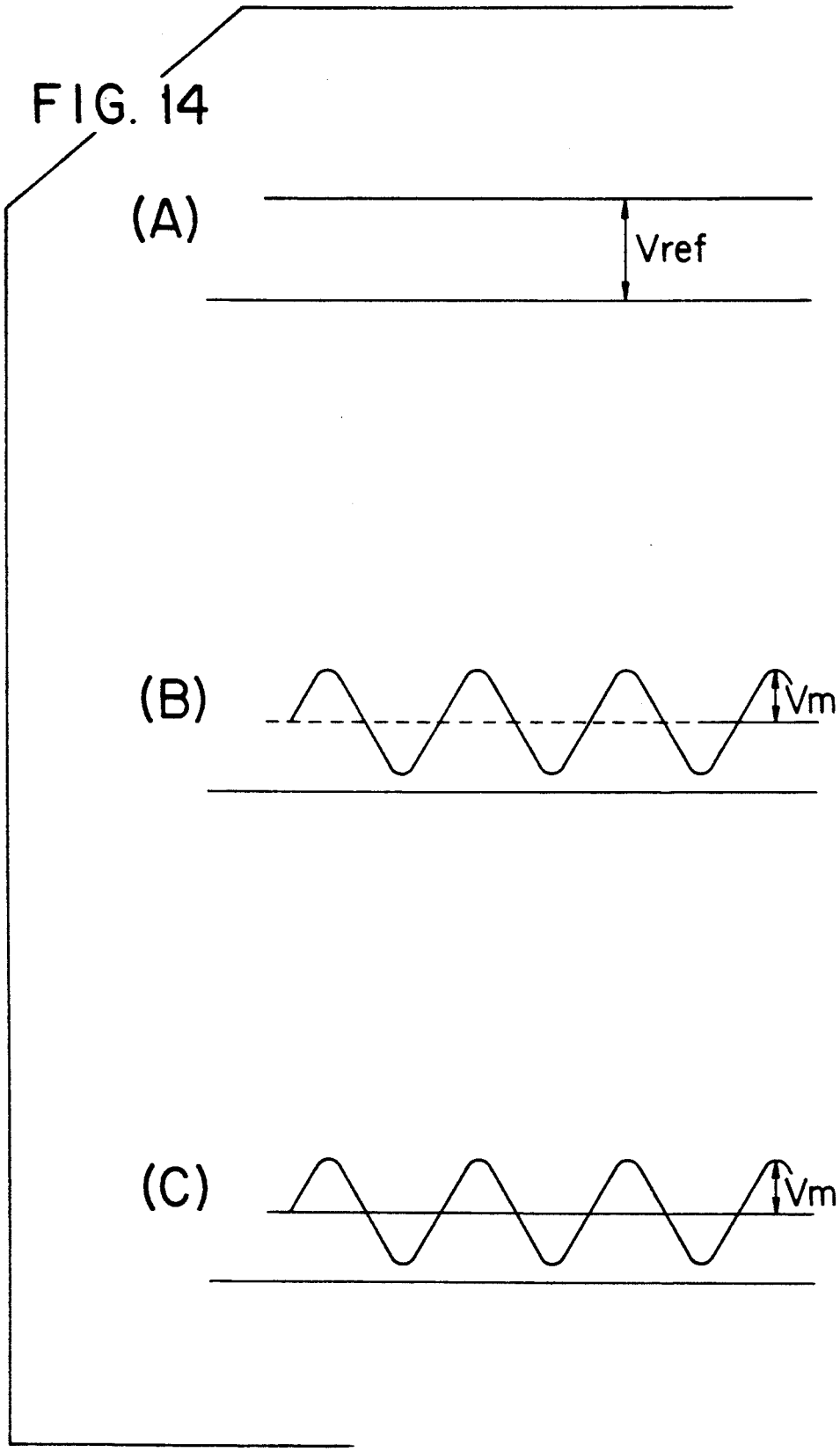
FIG. 14 is a waveform view illustrating a constant regulated voltage wave A, an excitation frequency wave B and a combination wave C thereof.

The reference voltage generating circuit 22 is formed as a constant voltage regulated circuit for applying the D.C. bias to the flame rod structure 100, in which the D.C. bias is the signal of a waveform A shown in FIG. 14.

The excitation frequency signal generating circuit 26 creates the excitation signal of an A.C. component having a predetermined frequency, which is adjusted by the microprocessor 20. The excitation signal appears as the waveform B of FIG. 14, wherein a voltage Vm or Vex(t) is represented as follows:

$$Vex(t)=Vmsin\ (wt+\phi).$$

Thus, the mixer 24 generates the signal of the frequency band for improving the electrical characteristic of the flame rod structure 100, in which the signal has a waveform C adding the waveform A to the waveform B, which represents the A.C. component voltage as follows:

$$Vc=Vref+Vmsin\ (wt+\phi)$$

The flame rod structure 100 senses the flame state in addition to receiving the signal from the mixer 24 and then generates the flame sensing voltage according to the medium material of the flame rod structure 100. The flame sensed signal is inputted to a flame signal detecting circuit 28 and an excitation frequency separating circuit 34.

The flame signal detecting circuit 28 convolutes (raises) the flame detected signal to a voltage according to the frequency and the calorific step. Herein, the voltage is represented as follows:

$$V_D=Vref+Vmsin\ (wt+\phi)*V_{FR}.$$

The convoluted flame detecting signal is applied to a low pass filter 30. The low pass filter 30 receives only the flame detecting signal $V_{FR}$ by means of an attenuator 38 connected through a voltage-frequency converter 36 to the third A/D converting port $P_3$, because the attenuator 38 forces the signal from the flame signal detecting circuit 28 to be made into a voltage signal of the A.C. component adding the waveform A to the waveform B to remove the excitation signal component from the flame signal detecting circuit 28. Herein, the voltage signal is represented as follows:

$$V_E=V_D-V_B$$

Thus, the low pass filter 30 permits only the frequency component of the actual flame detecting signal to be applied to a waveform shaping circuit 32. That is, the flame detecting signal is represented as follows:

$$V_F=V_{FR}=V_E$$

The waveform shaping circuit 32 applies the predetermined rectangular wave signal to the first analog/digital(A/D) converting port $P_1$ of the microprocessor 20. At the same time, the signal from the flame rod structure 100 is applied to the excitation frequency separating circuit 34. The excitation frequency separating circuit 34 removes the excitation frequency, converts it into a frequency-voltage signal, and then applies this converted signal to the second A/D converting port $P_2$ of the microprocessor 20.

Figure 13:
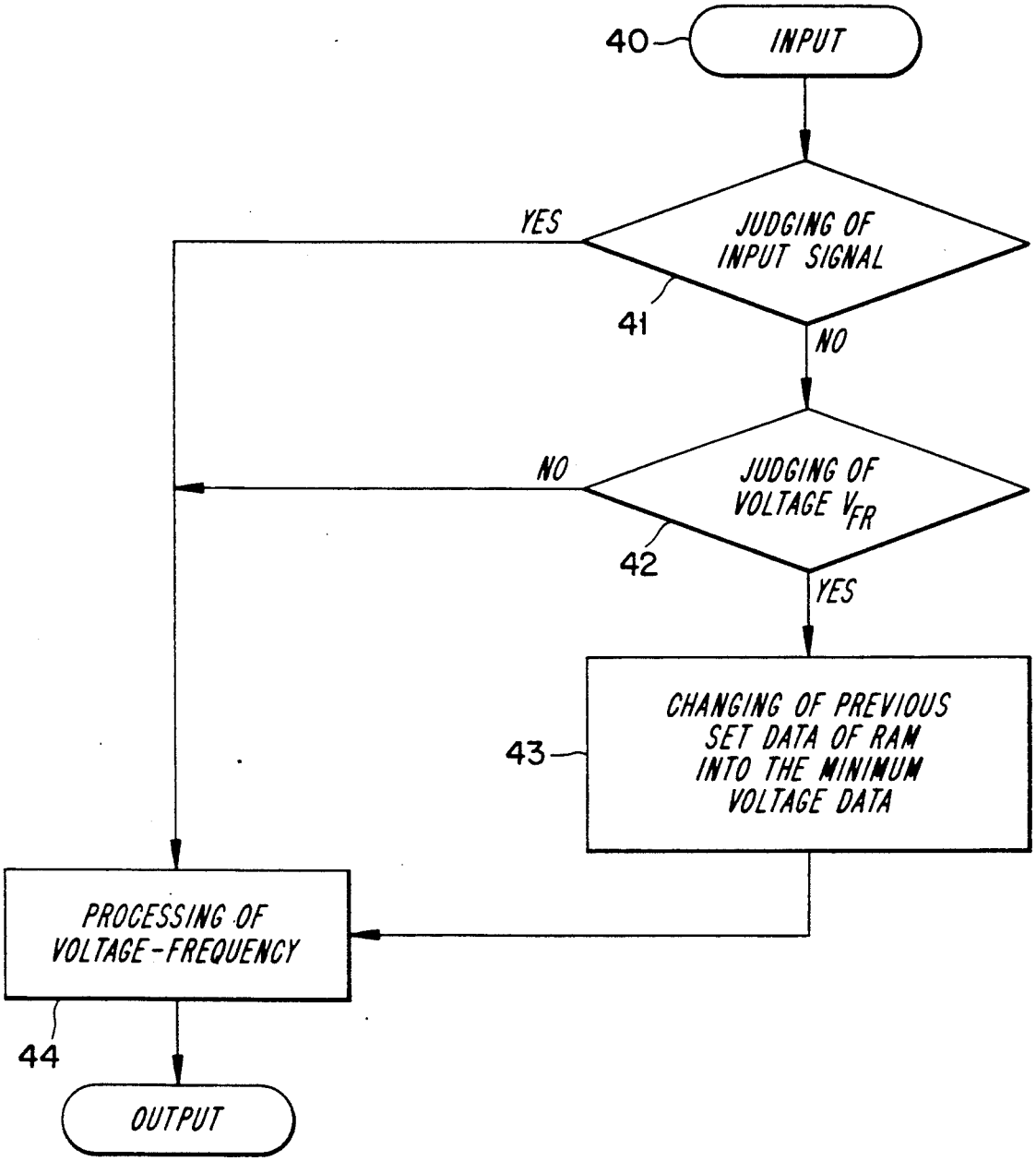
FIG. 13 is a flowchart illustrating a method for controlling the compensating circuit according to the principle of the present invention.

The microprocessor 20 controls the compensating circuit as shown in FIG. 13.

Referring to FIG. 13, at step 40 the microprocessor 20 receives the signals from the excitation signal separating circuit 34 and the waveform, shaping circuit 32. Step 40 goes onto step 41 to judge whether the input frequency-voltage data is the frequency-voltage data previously stored in RAM. When they are equal, step 41 moves onto step 44 to convert the excitation signal into a voltage-frequency signal and outputs the converted signal at the third A/D converting port $P_3$ to the voltage-frequency converter 36. Otherwise, step 41 goes onto step 42 to judge whether the flame detecting signal $V_{FR}$ is equal to the minimum voltage previously stored in RAM of the microprocessor. If not, step 42 moves onto step 44 to converts the flame detecting signal into the voltage-frequency signal and output the converted signal at the third A/D converting port $P_3$ to the voltage-frequency converter 36. If the flame detecting signal $V_{FR}$ is equal to the minimum voltage, step 12 goes onto step 43 to convert the previously set RAM data into the minimum voltage and then moves onto step 44.

Therefore, the microprocessor 20 outputs the voltage-frequency converting signal having the predetermined excitation frequency through the D/A converting port $P_3$ to the voltage-frequency converter 36 according to the heating step of the flame rod structure, in which the voltage-frequency converter 36 converts the signal of the microprocessor 20 into the voltage-frequency signal and supplies it to the excitation frequency signal generating circuit 26.

As described above, a compensating circuit of the present invention supplies the current of the A.C. component to a flame rod structure 100 in addition to the signal of the D.C. component, so that it prevents the flow of skin current from being reduced.

What is claimed is:

1. A flame rod structure comprised of:

a composition containing a semiconductor material micro-powder of silicon and germanium and a metal micro-powder of iron and nickel, wherein said semiconductor material is 3–5% by its weight ratio, sintered with said metal powder, crushed into micro-particles, melted with an adhesive agent, cooled and pressed/molded at a high pressure.

2. The flame rod structure according to claim 1, wherein said semiconductor material and said metal form a ferrite composition.

3. The flame rod structure according to claim 1, wherein said semiconductor material and said metal form a structure having a high interior impedance, said structure acting as a sensor according to time elapsed and an exterior disturbance.

4. A flame rod structure comprising:

a semiconductor material coated at a predetermined thickness on a metal flame rod surface forming a metal-semiconductor material.

5. The flame rod structure according to claim 4, wherein said metal-semiconductor material is a ferrite composition.

6. The flame rod structure according to claim 4, wherein said metal-semiconductor material has a high interior impedance, said material performing as a sensor according to time elapsed and an exterior disturbance.

7. A circuit for compensating a skin current by applying an A.C. bias to a D.C. bias of a flame rod structure, said circuit comprising:

means for generating a D.C. bias signal;

means for generating an excitation frequency signal, said excitation signal being an A.C. bias relative to the flame rod structure;

means for mixing the D.C. bias signal with the excitation signal and generating a mixed signal of a predetermined frequency;

means for receiving the mixed signal, for sensing a flame state signal of said flame rod structure, and for generating a flame sensed signal;

means, connected to said sensing means, for separating the excitation signal from the flame sensed signal;

means, connected to said sensing means for convoluting said flame sensed signal to obtain a convoluted flamed sensed signal;

means for filtering the convoluted flame sensed signal to obtain a sensing frequency signal;

means for shaping a waveform of the sensing frequency signal and generating a shaped signal;

a microprocessor for processing said shaped signal and said excitation signal from said separating means and generating a compensating signal; and means for converting the compensating signal into a signal having a frequency indicative of a voltage of said compensating signal.

8. A method for controlling a compensating circuit comprising:

comparing first data associated with a frequency to voltage signal inputted at a first and a second analog/digital port to second data associated with a previously stored frequency to voltage signal;

determining whether an amplitude of a flame detecting signal is equal to a minimum detected voltage;

outputting an excitation frequency if said first data and said second data are equal and the amplitude of the flame detecting signal is not equal to the minimum voltage; and outputting the excitation frequency according to a heating stage of a flame rod structure if said first data and said second data are not equal and the amplitude of the flame detecting signal is equal to the minimum voltage.

9. A flame rod structure comprising:

a semiconductor powder; and a metal powder forming a composition with said semiconductor powder, said semiconductor powder of approximately 3–5% by its weight ratio being sintered with said metal powder, melted with an adhesive agent, cooled and pressed/molded at high pressure.

10. The flame rod structure of claim 9 wherein said semiconductor powder includes silicon and germanium and said metal powder includes iron and nickel.

11. A flame rod structure comprising:

a metal flame rod;

a semiconductor material for coating said metal flame rod, said coating being of a predetermined thickness.

12. The flame rod structure of claim 11 wherein said metal flame rod and said semiconductor material form a ferrite composition.

13. A compensating circuit for a flame rod structure, said circuit comprising:

means for generating a d.c. bias signal;

means for generating an excitation frequency signal related to an a.c. component voltage associated with said flame rod structure;

means for mixing the d.c. bias signal with said excitation signal and generating a mixing signal of a predetermined frequency;

means for sensing a flame state, receiving said mixing signal, and generating a flame sensed signal;

means, connected to said sensing means, for convoluting said flame sensed signal to obtain a convoluted flame sensed signal;

means for filtering said convoluted flame sensed signal to remove said excitation signal and to obtain a filtered signal;

means for shaping said filtered signal;

means connected to said sensing means for separating said excitation signal from said flame sensed signal;

means for processing said excitation signal from said separating means and said filtered signal and generating a compensating signal; and means for converting said compensating signal into a signal having a frequency indicative of a voltage of said compensating signal.

14. A method for controlling a compensating circuit used in a flame rod structure, said method comprising the steps of:

generating frequency data indicative of a flame state of said flame rod structure;

comparing frequency data with previously stored frequency data;

comparing an amplitude of a flame detecting signal to a minimum voltage previously stored; and generating an excitation signal based on said steps of comparing.

15. The method of claim 14, wherein if said frequency to voltage signal data is not equal to said previously stored frequency to voltage signal data and said amplitude of said flame detecting signal is equal to said minimum voltage, said excitation frequency is based on a heating stage of said flame rod structure.

* * * * *